US007988209B2

(12) United States Patent
Hudson

(10) Patent No.: US 7,988,209 B2
(45) Date of Patent: Aug. 2, 2011

(54) TAMPER EVIDENT SECURITY DEVICE HAVING A DOUBLE CLICK SEAL

(75) Inventor: Barry Hudson, Lower Templestowe (AU)

(73) Assignee: Tebco Pty Limited, Lowloon (HK)

( * ) Notice: Subject to any disclaimer, the term of this patent is extended or adjusted under 35 U.S.C. 154(b) by 170 days.

(21) Appl. No.: 10/951,297

(22) Filed: Sep. 27, 2004

(65) Prior Publication Data

US 2005/0218664 A1 Oct. 6, 2005

(30) Foreign Application Priority Data

Mar. 30, 2004 (AU) ..... 20041189

(51) Int. Cl.
*B65D 27/30* (2006.01)
*A41F 1/00* (2006.01)

(52) U.S. Cl. ..... 292/307 A; 292/307 R; 292/316; 24/700; 24/704.1

(58) Field of Classification Search ..... 292/307 A, 292/282, 307 R, 316, 318, 320, 321; 24/436, 24/629, 687, 700, 704.1, 704.2
See application file for complete search history.

(56) References Cited

U.S. PATENT DOCUMENTS 3,149,869 A * 9/1964 Chamberlin ..... 292/320
3,257,694 A * 6/1966 Litwin ..... 24/16 PB
3,414,943 A * 12/1968 Hattori ..... 24/200
3,897,611 A * 8/1975 Booth et al. ..... 24/628
3,955,842 A * 5/1976 Edwards ..... 292/307 R
3,967,351 A * 7/1976 Rosenberg et al. ..... 24/616
4,001,532 A * 1/1977 Kubota et al. ..... 200/61.58 B
4,106,801 A * 8/1978 De Lima Castro Neto ..... 292/307 R
4,281,441 A * 8/1981 Rasner ..... 24/700
4,398,324 A * 8/1983 Bakker et al. ..... 24/629
4,512,599 A * 4/1985 De Lima Castro Netto ..... 292/307 R
4,633,549 A * 1/1987 Lovato ..... 24/615
4,818,002 A * 4/1989 De Lima Castro Netto ..... 292/307 R
5,441,316 A * 8/1995 Georgopoulos ..... 292/320
5,533,767 A * 7/1996 Georgopoulos et al. ..... 292/320
5,915,629 A * 6/1999 Ribeiro ..... 24/16 R
6,360,411 B1 * 3/2002 Bortz ..... 24/704.2
6,401,313 B1 * 6/2002 LeVey ..... 24/629
6,533,335 B2 3/2003 Hudson
6,640,394 B1 * 11/2003 Berrocal et al. ..... 24/16 PB
6,933,844 B2 * 8/2005 Augspurger et al. ..... 340/545.1
2003/0229974 A1 * 12/2003 Zemer et al. ..... 24/303

* cited by examiner

*Primary Examiner* — Carlos Lugo
(74) *Attorney, Agent, or Firm* — Leonard Tachner

(57) ABSTRACT

An improved seal for a tamper evident security device employs out-of-plane curved barbs and an elongated slot to provide visual and tactile indications of proper seal installation. The out-of-plane curved barbs require elevating the seal body for installation. Only if the barbs are properly inserted into a seal receptacle does the body then assume a flat contiguous position. The elongated slot cooperates with a raised bar on the security device to provide a second distinct indication of proper seal installation.

8 Claims, 6 Drawing Sheets

TAMPER EVIDENT SECURITY DEVICE HAVING A DOUBLE CLICK SEAL

CROSS REFERENCE TO RELATED APPLICATIONS

This application takes priority from Australian Patent Application Serial No. 1189/2004 filed Mar. 30, 2004.

BACKGROUND OF THE INVENTION

1. Field of the Invention

The present invention relates to a tamper evident security device for a slide fastener and more particularly to an improvement therein which assures proper installation of the seal used therein.

2. Background Art

The present invention is designed to be an improvement of the security device disclosed in U.S. Pat. No. 6,533,335, the content of which is hereby incorporated herein as if fully set forth. The patent discloses a security device for slide fastener having a frangible locking element or seal for linking a housing to a closure member. The seal is resiliently yieldable and slideably insertable into the closure member but is designed to be not retractable therefrom without fracturing the frangible locking seal. Retraction of the seal is designed to be prevented by a pair of angled barbs or hooks which, when properly installed in a seal receptacle, are first compressed and then engaged so that the seal cannot be withdrawn without breaking it first.

However, if inadvertently, the seal is inserted into the chamber so that the barbs are compressed but not engaged, the seal will appear to be inserted, but it is not and it may be removed easily without breaking it first. This, of course, defeats the tamper evident feature of that invention by permitting opening of the slide fastener without breaking the seal. Subsequent re-insertion of the unbroken seal would leave no evidence of tampering and thus defeat the principal purpose of the security device. It would be a significant improvement if there were a visible exterior indication of whether or not the seal is fully inserted and engaged.

SUMMARY OF THE INVENTION

The present invention provides a visible exterior indication of whether or not the seal is fully inserted and engaged so that it cannot be inadvertently installed without complete engagement.

The present invention achieves this by keeping the seal body visibly raised until the seal is inserted past the point at which the barbs engage (the first "click"). Subsequent to the barbs engaging, a slot across the under side of the tab then engages with a raised bar across the top side of the lid flange. As the tab engages the bar, it drops down (the second "click") to assume the normal inserted attitude. The aim is achieved because the tab remains visibly raised until the barbs engage. The tab slot and top bar engagement also form an additional barrier to a probe entry under the seal. The bar necessitates the seal be entered at an angle. This angle of entry is such that the seal bends to the degree that the bend stresses the seal material just short of the elastic limit. This means that the seal tab will spring over the bar to assume a normal attitude but if the tab is raised to an extent to allow a probe entry over the bar, the elastic limit is easily exceeded and a permanent raised set is difficult to avoid. The tab slot and bar engagement does not affect the normal tab upwards breakage action.

A second feature of the seal is that the barbs have an upward engagement in addition to the normal sideways engagement. This compounds the complexity of any proposed seal extraction probe to a substantial degree.

BRIEF DESCRIPTION OF THE DRAWINGS

The aforementioned objects and advantages of the present invention, as well as additional objects and advantages thereof, will be more fully understood herein after as a result of a detailed description of a preferred embodiment when taken in conjunction with the following drawings in which.

DETAILED DESCRIPTION OF A PREFERRED EMBODIMENT

Figure 2:
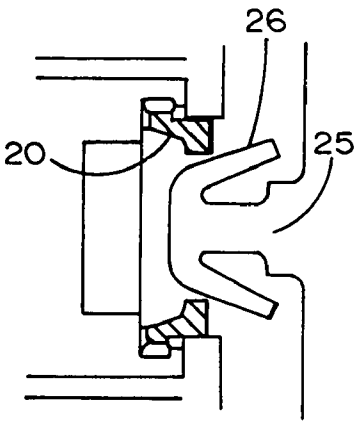
FIG. 2 is a top view of the seal barbs at the point of insertion corresponding to FIG. 1.
Figure 1:
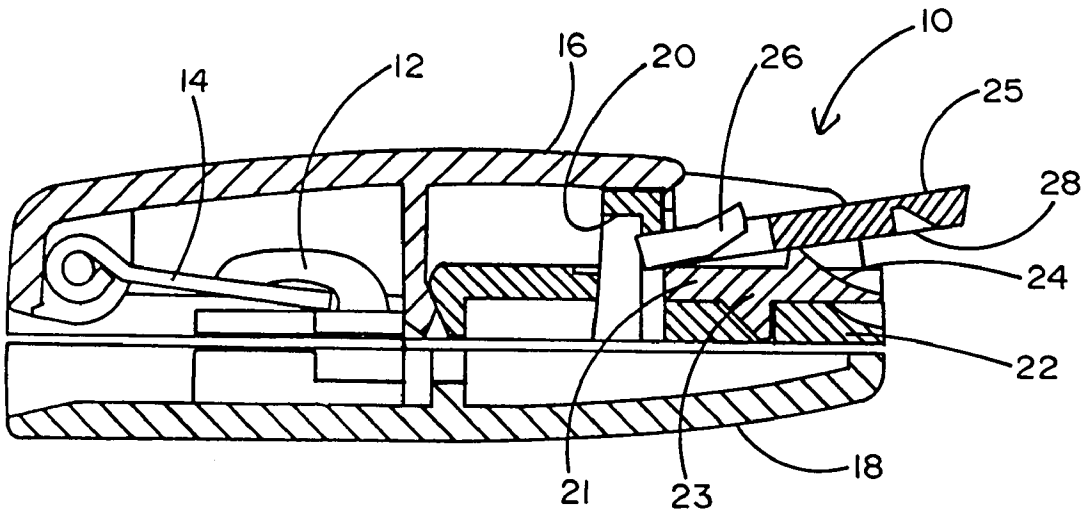
FIG. 1 is a side partially cross-sectioned view of the security device shown as the seal is initially inserted into the receptacle.
Figure 4:
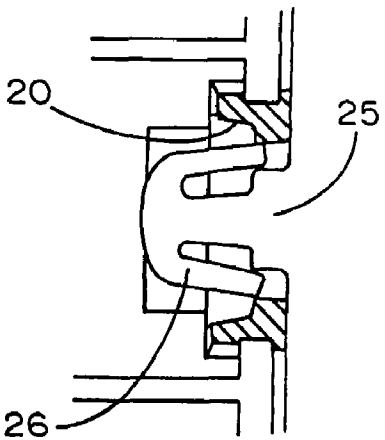
FIG. 4 is a view similar to FIG. 2 but corresponding to the point of insertion of FIG. 3.
Figure 3:
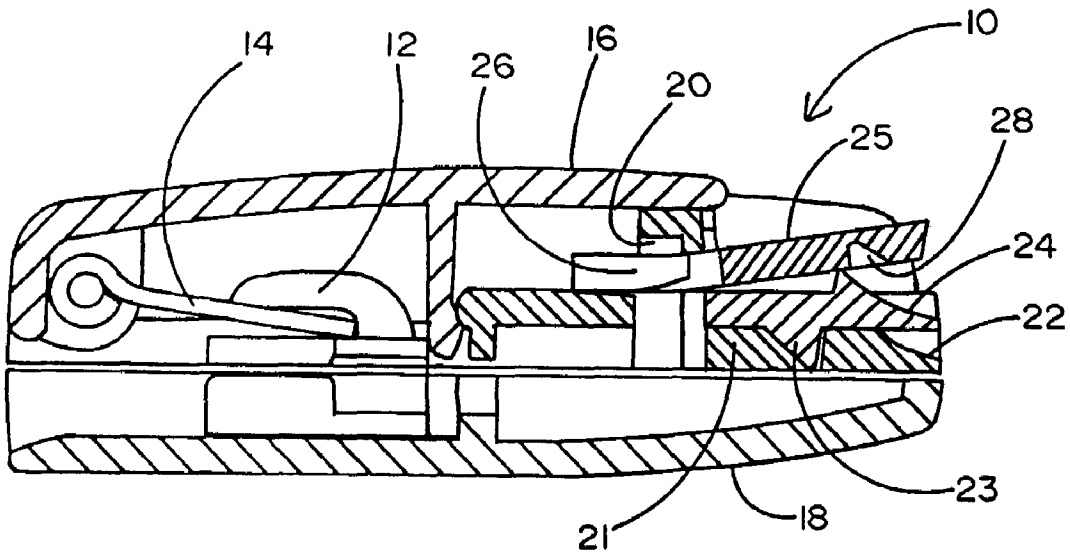
FIG. 3 is a view similar to FIG. 1 but showing a more advanced stage of seal insertion.
Figure 6:
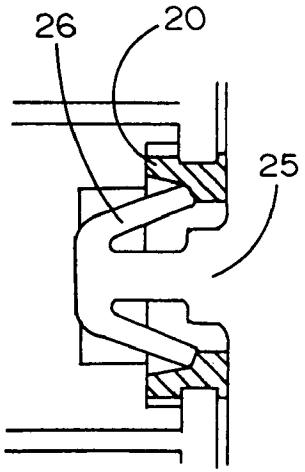
FIG. 6 is a view similar to FIG. 4 but corresponding to the point of insertion of FIG. 5.
Figure 5:
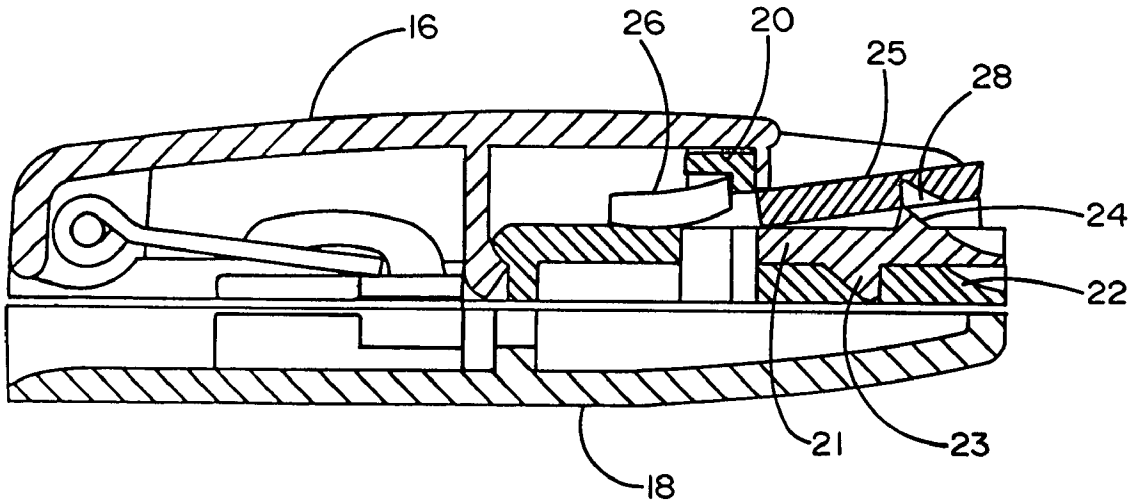
FIG. 5 is a view similar to FIG. 3 but showing the stage of seal insertion at which the first "click" occurs.
Figure 8:
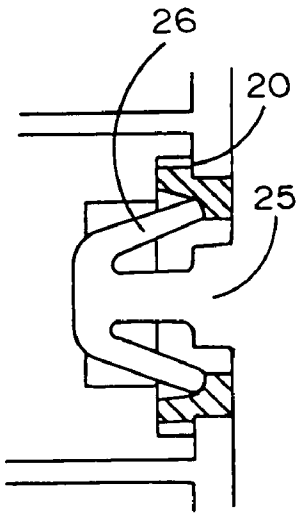
FIG. 8 is a view similar to FIG. 6 but corresponding to the final stage of seal insertion of FIG. 7.
Figure 7:
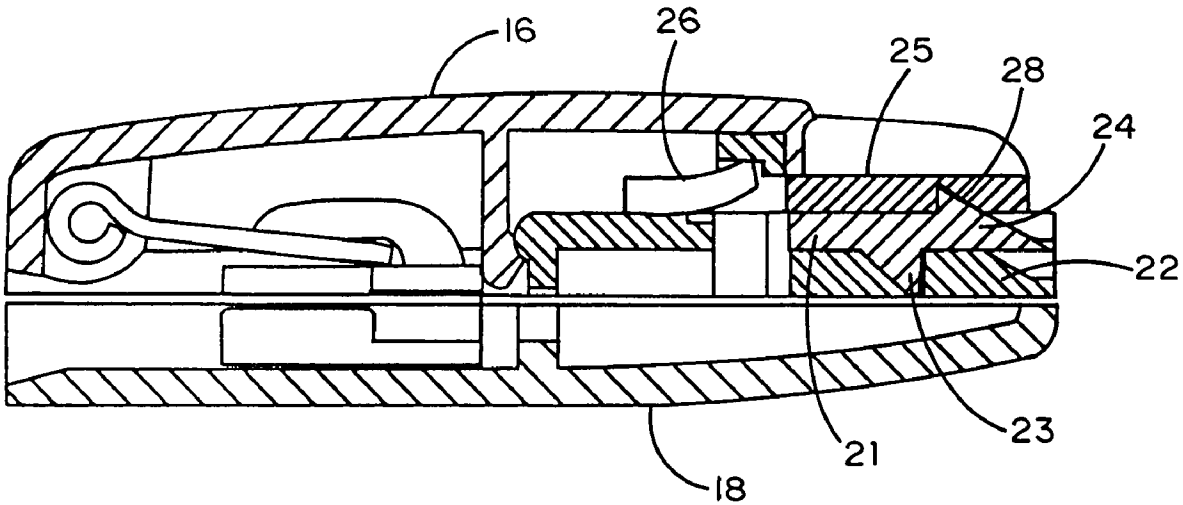
FIG. 7 is a view similar to FIG. 5 but showing the final stage of seal insertion at which the second "click" occurs.
Figure 11:
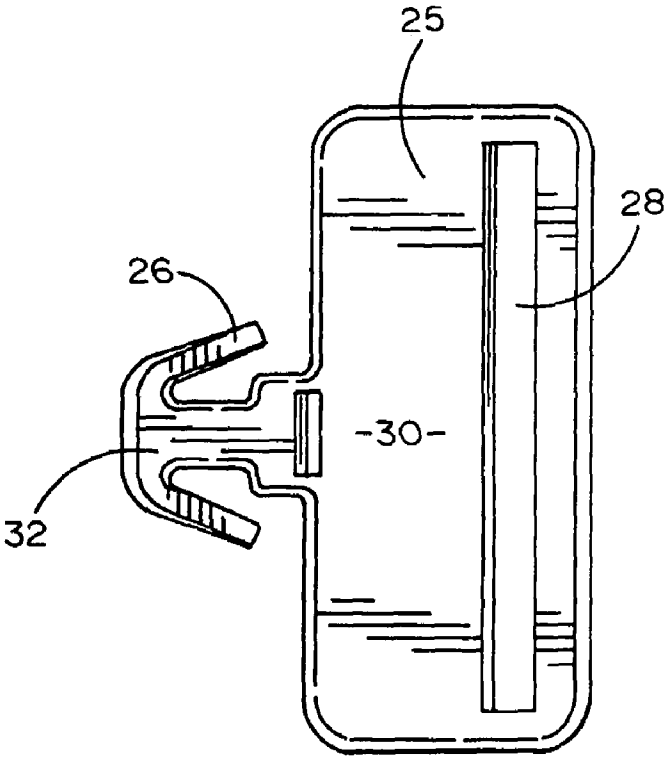
FIG. 11 is a bottom plan view of the seal.
Figure 9:
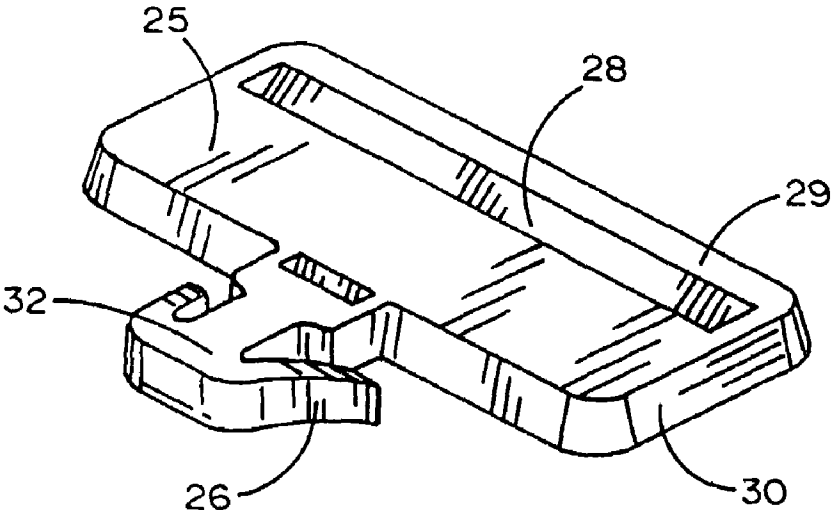
FIG. 9 is a perspective view of the lower surface of the seal of the preferred embodiment.
Figure 10:
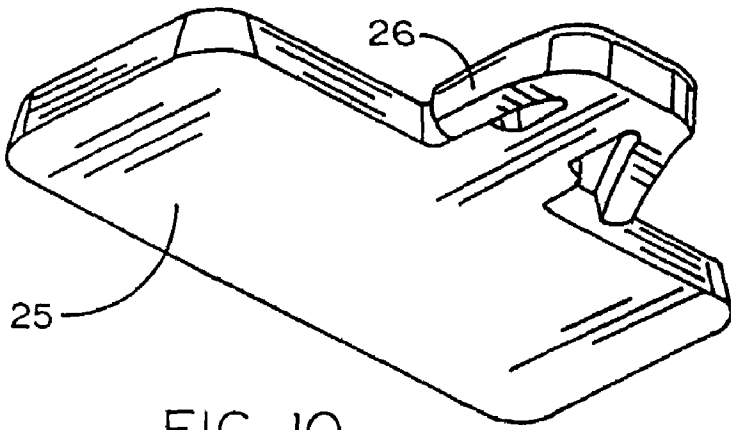
FIG. 10 is a perspective view of the upper surface of the seal.
Figure 13:
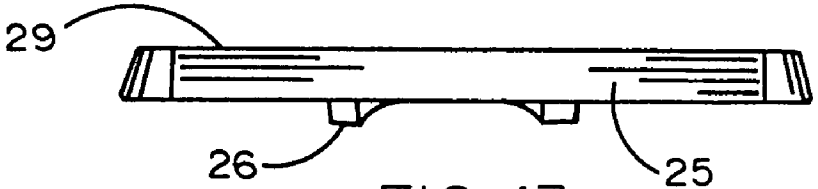
FIG. 13 is a rear view of the seal.
Figure 14:
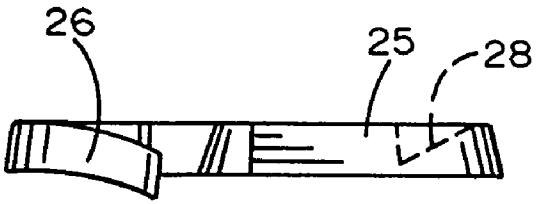
FIG. 14 is a side view of the seal.
Figure 15:
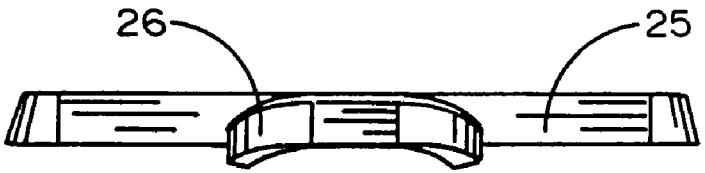
FIG. 15 is a front view of the seal.
Figure 12:
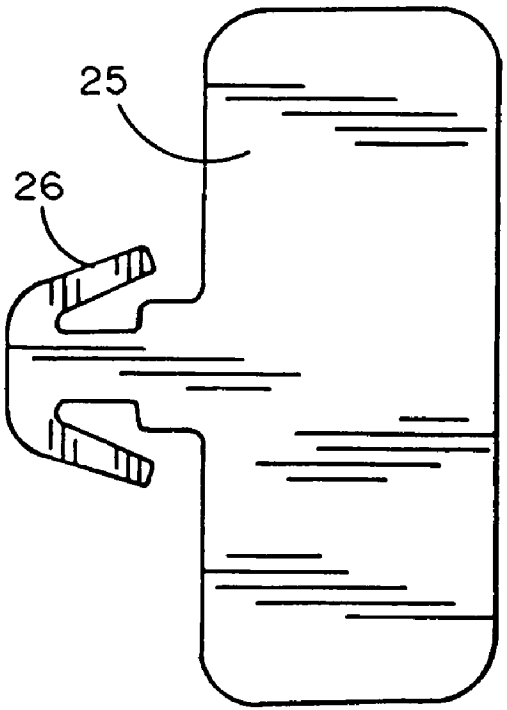
FIG. 12 is a top plan view of the seal.

Referring to the accompanying drawings and initially to FIGS. 1 through 8, it will be seen that a seal enclosure 10 surrounds a zipper slider 12 to which a puller 14 is attached for opening and closing a zipper (not shown) as disclosed in FIG. 1 of U.S. Pat. No. 6,533,335. The puller 14 is rotatably attached to a closure member 16 which cooperates with a housing 18 to enclose a seal receptacle 20. The receptacle 20 is configured for receiving a frangible seal 25 having flexible barbs 26.

Housing 18 has a lower flange 22 which receives an upper flange 21, joined thereto by a flange interface 23. The upper flange 21 has a triangular cross-section shaped raised bar 24.

As seen best in FIGS. 9 through 15, seal 25 has a generally rectangular body 30 and a probe-like extension 32 from which the barbs 26 extend. As seen in FIGS. 9 through 15, barbs 26 are curved out of the plane of body 30 so that they extend both laterally and vertically from extension 32. In this regard, barbs 26 differ from similar seals of the prior art known to the applicant. Seal barbs of the known prior art are generally co-planar with the body of the seal. Another distinguishing feature of the seal of the present invention is the elongated triangular-shaped notch or slot 28 in the bottom surfaces 29 of the body 30. It is the combination of the out-of-plane curve of the barbs 26 and the slot 28 which provides the visual and tactile assurance of a proper seal engagement afforded by the present invention.

Referring again to FIGS. 1 through 8 which together form a sequential illustration of seal installation, it will be seen (in FIGS. 1 and 2) that because of the out-of-plane curvature of the barbs 26 and the raised bar 24, the seal 25 is initially angled upwardly to be inserted into the seal receptacle 20. As the seal 25 is gradually advanced into the receptacle 20 (see FIGS. 3 through 6), the angle of the seal is gradually reduced until the barbs 26 engage the receptacle 20. At this point there is a perceptible first "click" as the compressed barbs expand into their secured expanded position. The body 30 of the seal is then sufficiently aligned with the upper flange 21 so that the raised bar 24 may be fully engaged with the slot 28 (see FIG. 7) and the body 30 becomes fully parallel and contiguous with upper flange 21. At this point there is a perceptible second "click" as the raised bar 24 enters the slot 28. Thus, it will be seen that because of the novel structural improvements of the present invention, the look and feel of a seal lying flat against the enclosure flange and the sense of two distinct "clicks" as the seal is properly installed, assure that there is proper engagement of the seal barbs with the receptacle and precludes inadvertent non-engagement of the seal.

Having thus disclosed a preferred embodiment of the invention, it will be understood that numerous modifications may be made. By way of example, the body slot and raised bar may be readily interchanged so that the bar is on the underlying surface of the seal body and the slot is in the underlying flange surface. Accordingly, the scope hereof is to be limited only by the appended claims and their equivalents.

I claim:

1. A tamper evident security device comprising:

a seal receptacle for receiving compressible barbs extending from a seal and requiring breaking of the seal to open the security device;

said seal having a substantially planar body and said compressible barbs extending from said body for first locking engagement with said seal receptacle in a first position; said barbs extending out of the plane of said body, said body being supported relative to said seal receptacle at an angular elevation in said first position having said barbs fully engaged with said seal receptacle, said body being at a zero elevation in a second position, said barbs being configured thereby to be fully engaged with said receptacle before said body angular elevation can be reduced to zero, said body in said second position forming a second locking engagement with a flange member extending from said seal receptacle, whereby an elevated position of said seal indicates improper engagement of said seal and said seal receptacle.

2. The device recited in claim 1 wherein said seal receptacle has a raised bar and said seal body comprises a slot for receiving said bar.

3. The device recited in claim 1 wherein said seal barbs emit a perceptible indication when they properly engage said receptacle.

4. The device recited in claim 1 wherein said seal body slot emits a perceptible indication when it properly engages said raised barb.

5. An improved tamper evident security device having a frangible seal received in a seal receptacle, the seal preventing the opening of the security device without first breaking the seal thereby leaving evidence of tampering; the improvement comprising:

a seal having a body portion and a plurality of out-of-plane compressible barbs that are configured to protrude vertically and laterally from said body portion so tat they can be inserted into said seal receptacle only when said seal is first angled upwardly from said security device, said barbs in a first position forming a first locking engagement with said seal receptacle, said seal being supported by a flange member extending from said seal receptacle to remain in said first position at an angled upward position having said barbs fully engaged with said seal receptacle, said body portion being at a zero elevation in a second position to form a second locking engagement with said flange member.

6. The improvement recited in claim 5 further comprising a slot and bar interface between said seal and said seal receptacle, said barbs being configured to be fully engaged within said seal receptacle before said interface can be activated.

7. The improvement recited in claim 5 wherein said said body portion is substantially planar and wherein said barbs extend out-of-the-plane of said body portion.

8. An improved tamper evident security device having a frangible seal received in a seal receptacle, the seal preventing the opening of the security device without first breaking the seal thereby leaving evidence of tampering; the improvement comprising:

a seal having a body portion and a plurality of out-of-plane compressible barbs that are configured to protrude vertically and laterally from said body portion, said barbs in a first position forming a first locking engagement with said seal receptacle, said seal being supported by a flange member extending from said seal receptacle to remain in said first position at an angled upward position having said barbs fully engaged with said seal receptacle, said body portion being at a zero elevation in a second position to form a second locking engagement with said flange member; and, a slot and bar interface between said seal and said seal receptacle, said interface preventing said seal from seating into said receptacle until fully engaged therewith.

* * * * *